US012324522B2

(12) United States Patent
Leng

(10) Patent No.: US 12,324,522 B2
(45) Date of Patent: Jun. 10, 2025

(54) BED LADDER CONFIGURED TO BE INSTALLED ON BED FRAME FOR USE

(71) Applicant: Luhao Leng, Xiamen (CN)

(72) Inventor: Luhao Leng, Xiamen (CN)

( * ) Notice: Subject to any disclaimer, the term of this patent is extended or adjusted under 35 U.S.C. 154(b) by 267 days.

(21) Appl. No.: 18/095,698

(22) Filed: Jan. 11, 2023

(65) Prior Publication Data

US 2023/0240448 A1 Aug. 3, 2023

(30) Foreign Application Priority Data

Jan. 28, 2022 (CN) ..... 202220240572.7
May 19, 2022 (CN) ..... 202221210065.5

(51) Int. Cl.
*A47C 19/22* (2006.01)
*A47C 19/20* (2006.01)

(52) U.S. Cl.
CPC ..... *A47C 19/22* (2013.01); *A47C 19/20* (2013.01)

(58) Field of Classification Search
CPC ..... A47C 19/22; A47C 19/20
USPC ..... 9/2.1
See application file for complete search history.

(56) References Cited

U.S. PATENT DOCUMENTS 4,063,836 A * 12/1977 Militano ..... F16B 7/0446 403/322.2
4,218,793 A * 8/1980 Hooker ..... A47C 19/205 5/8
4,896,385 A * 1/1990 Bustos ..... A47C 19/20 D6/390
4,913,262 A * 4/1990 DeBlois ..... E06C 7/505 5/9.1
5,785,447 A * 7/1998 Fonti ..... E04H 17/1413 403/396
7,051,384 B1 * 5/2006 Guillot ..... A47C 21/08 5/430
9,044,100 B1 * 6/2015 Wang ..... A47C 19/20
2010/0180379 A1 * 7/2010 Leng ..... A47C 21/08 5/425
2011/0011679 A1 * 1/2011 Leng ..... E06C 7/086 182/194
2017/0245650 A1 * 8/2017 Leng ..... A47C 21/08
2020/0146460 A1 * 5/2020 Leng ..... A47C 19/025
2022/0125211 A1 * 4/2022 Hong ..... F16B 12/54
2023/0200547 A1 * 6/2023 Leng ..... A47C 19/02 5/8
2024/0032701 A1 * 2/2024 Chen ..... A47C 19/005

* cited by examiner

*Primary Examiner* — Myles A Throop
(74) *Attorney, Agent, or Firm* — Cooper Legal Group, LLC

(57) ABSTRACT

A bed ladder configured to be installed on a bed frame comprises an upper frame transverse bar and a lower frame transverse bar, and the upper frame transverse bar and the lower frame transverse bar are parallel to each other and located on a vertical plane. The bed ladder comprises two handrails symmetrically arranged in a left-and-right direction and a plurality of step bars connected to the two handrails, and the bed ladder is vertically arranged. The upper frame transverse bar and the lower frame transverse bar cooperate with each other to clamp the bed ladder to inhibit movement of the bed ladder in a vertical direction, and an upper end of each of the two handrails is connected to the upper frame transverse bar in an inserted manner. A lower end of each of the two handrails is connected to the lower frame transverse bar in an inserted manner.

15 Claims, 9 Drawing Sheets

BED LADDER CONFIGURED TO BE INSTALLED ON BED FRAME FOR USE

RELATED APPLICATIONS

This application claims priority to Chinese patent application number 202220240572.7, filed on Jan. 28, 2022, and Chinese patent application number 202221210065.5, filed on May 19, 2022. Chinese patent application number 202220240572.7 and Chinese patent application number 202221210065.5 are incorporated herein by reference.

FIELD OF THE DISCLOSURE

The present disclosure relates to a ladder, in particular to a bed ladder installed on a bed frame for use.

BACKGROUND OF THE DISCLOSURE

When a bunk is relatively high, such as an upper bunk of a double-layer bed, or a loft bed comprising a study table set under a bunk of the loft bed, it is necessary to climb up and down the bunk by means of a ladder. The traditional installation method of the ladder is to directly weld and fix with the bed frame, which is inconvenient for transportation and cannot be disassembled. Therefore, most bed frames use bolts to achieve locking instead of welding, but the bolt installation method easily loosens and is not firm enough. Moreover, the installation methods of on-site welding and bolt locking make it difficult for one person to complete the installation operation independently, and other people are needed to help hold the ladder for installation and operation, so the installation is not easy enough.

BRIEF SUMMARY OF THE DISCLOSURE

The present disclosure provides a bed ladder configured to be installed on a bed frame for use, which is convenient to assemble and disassemble and has good firmness. A first technical solution of the present disclosure is as follows.

A bed ladder configured to be installed on a bed frame is provided. The bed frame comprises an upper frame transverse bar and a lower frame transverse bar, and the upper frame transverse bar and the lower frame transverse bar are parallel to each other and located on a same vertical plane. The bed ladder comprises two handrails symmetrically arranged in a left-and-right direction and a plurality of step bars connected to the two handrails, and the bed ladder is vertically arranged. The upper frame transverse bar and the lower frame transverse bar cooperate with each other to clamp the bed ladder to inhibit movement of the bed ladder in a vertical direction, and an upper end of each of the two handrails is connected to the upper frame transverse bar in an inserted manner. A lower end of each of the two handrails is connected to the lower frame transverse bar in an inserted manner.

The bed ladder is directly clamped by the upper frame transverse bar and the lower frame transverse bar in the vertical direction. The bed ladder is very convenient to disassemble and assemble. After the bed frame is assembled, the bed ladder can be installed on the bed frame by lifting the upper frame transverse bar slightly. In addition to the upper frame transverse bar and the lower frame transverse bar restricting the bed ladder, a weight of the upper frame can also prevent the bed ladder from accidentally detaching during use, and the firmness of the bed ladder is guaranteed.

In a preferred embodiment, two ends of each of the two handrails respectively comprise two sleeves, and each of the two sleeves has a U-shaped groove. The two sleeves are respectively sleeved on the upper frame transverse bar and the lower frame transverse bar using the U-shaped groove. The upper frame transverse bar and the lower frame transverse bar are clamped by the two sleeves, which is convenient for assembly and improves the structural stability after assembly.

In a preferred embodiment, the upper end of each of the two handrails comprises a longitudinal tongue, and the upper frame transverse bar comprises a longitudinal opening configured to receive the longitudinal tongue in an inserted manner. The lower end of each of the two the handrails comprises a transverse tongue, and the lower frame transverse bar comprises a transverse opening configured to receive the transverse tongue in an inserted manner. The upper end and the lower end of each of the two handrails comprise the longitudinal tongue and the transverse tongue in different directions to ensure that an installation direction of the bed ladder will not be reversed, especially when a stepping distances on an upper and a lower side of the bed ladder are different, to ensure the correctness of the installation.

In a preferred embodiment, the upper frame transverse bar and the lower frame transverse bar each comprise a receiving hole for receiving an end portion of each of the two handrails, or the upper frame transverse bar and the lower frame transverse bar each comprise a joint for being inserted into the end portion of each of the two handrails, which has simple structure to achieve the means of inserting.

In a preferred embodiment, each of the plurality of step bars is a hollow pipe with a triangular cross section, which has a larger stepping surface, saves material, and has better strength.

In a preferred embodiment, each end of each of the plurality of step bars is connected to the two handrails in an inserted manner, so that the two handrails are configured to clamp the plurality of step bars to inhibit movement of the plurality of step bars in the left-and-right direction. The two handrails and the plurality of step bars are assembled in an inserted manner, and the upper frame transverse bar, the lower frame transverse bar, and the two handrails are also assembled in an inserted manner, which is convenient for assembly.

In a preferred embodiment, all sides of an upper frame of the bed frame are disposed with guardrails, and the upper frame transverse bar is a lower bottom bar of a corresponding one of the guardrails. The lower bottom bar of the corresponding one of the guardrails directly serves as the upper frame transverse bar, which can simplify the structure of the bed frame and make the bed frame easier to assemble.

In a preferred embodiment, the bed ladder is located on a side of the bed frame in a width direction having a width less than a length of the bed frame, which does not affect use of a space under the bed frame.

In a preferred embodiment, one or more of the guardrails corresponding to the bed ladder comprises an opening aligned with the bed ladder, and a width of the opening is the same as a width of the bed ladder.

In a preferred embodiment, the upper frame of the bed frame and a lower frame of the bed frame are connected together by four columns, and the four columns are disposed at four corners of the bed frame.

In a preferred embodiment, the opening of the one or more of the guardrails is located in a middle of the one or more of the guardrails, and two vertical side bars on two sides of the one or more of the guardrails are respectively connected to two of the four columns. A lower end of two vertical side bars on a left side and a right side of the opening is terminated at the lower bottom bar of the corresponding one of the guardrails, and the two vertical side bars on the left side and the right side of the opening are vertically aligned with the two handrails of the bed ladder respectively.

In a preferred embodiment, a cross-sectional shape and a size of each of the two handrails are the same as that of each of the two vertical side bars.

In a preferred embodiment, the opening of the one or more of the guardrails is located in a side position of the one or more of the guardrails.

In a preferred embodiment, the bed frame is a metal bed frame, and the bed ladder is a metal bed ladder.

DETAILED DESCRIPTION OF THE EMBODIMENTS

Figure 1:
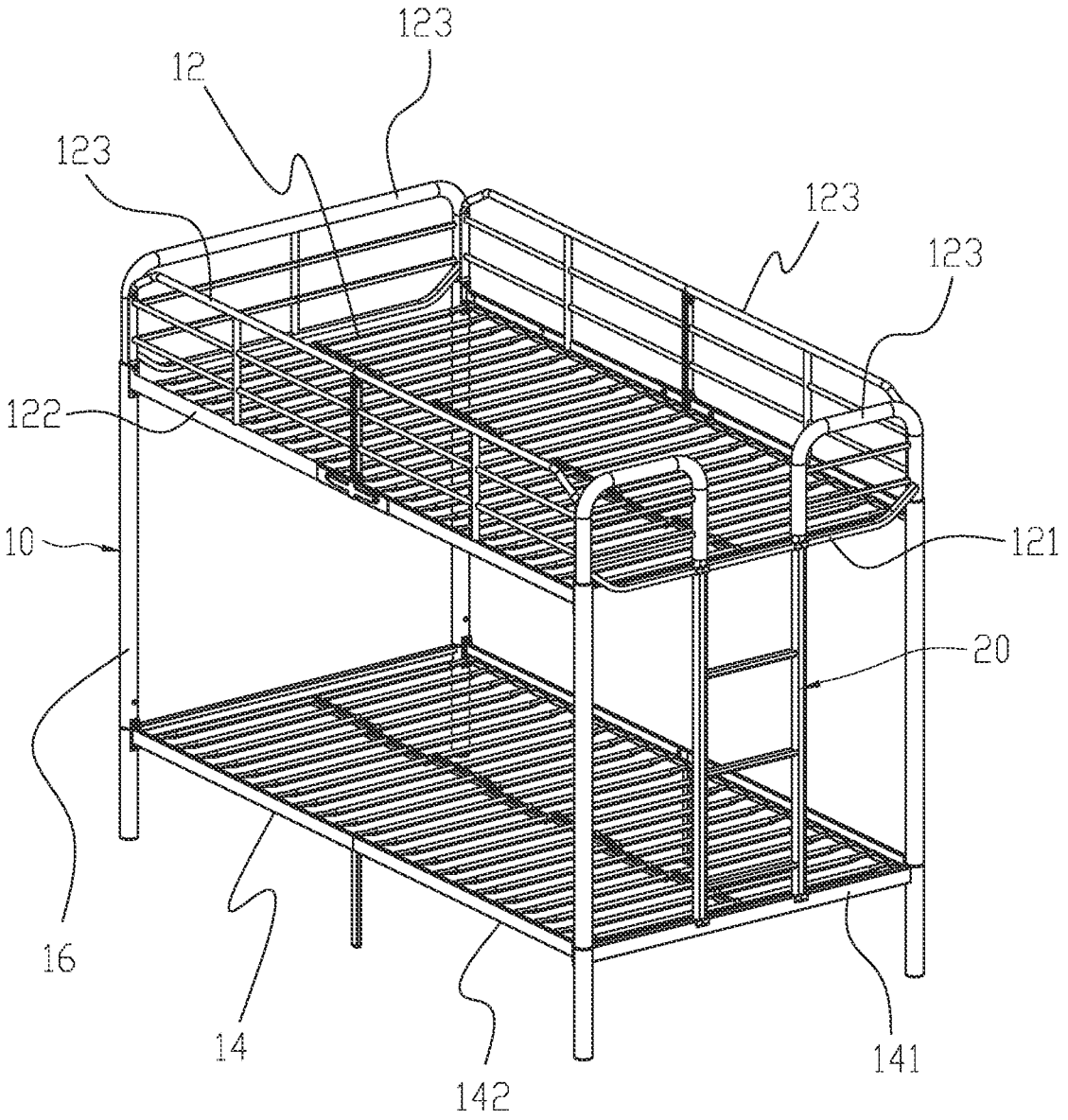
FIG. 1 illustrates a perspective view of a bed ladder configured to be installed on a bed frame for use in a first embodiment of the present disclosure.
Figure 2:
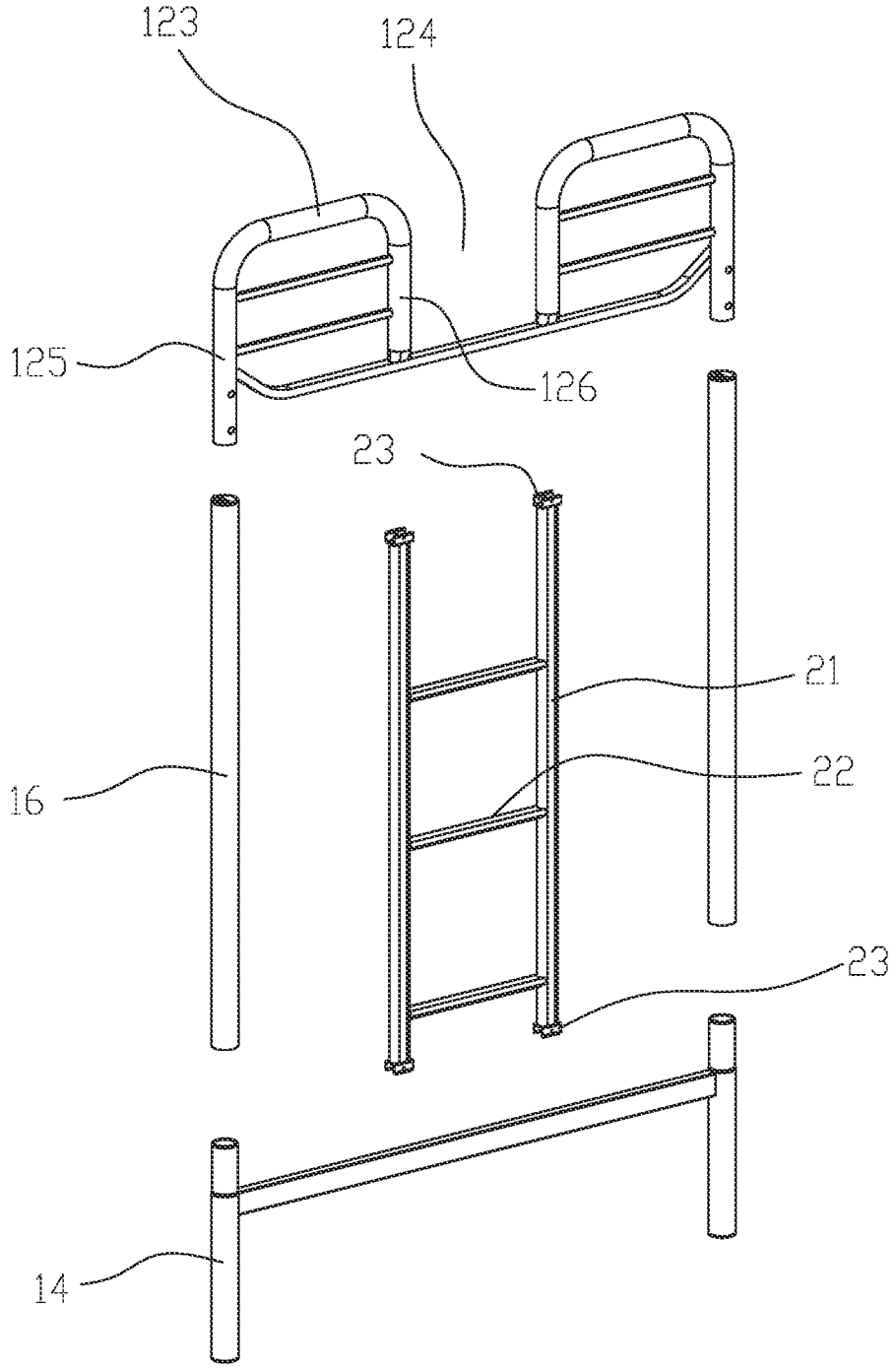
FIG. 2 illustrates a partially exploded view of the bed frame and the bed ladder in FIG. 1.
Figure 3:
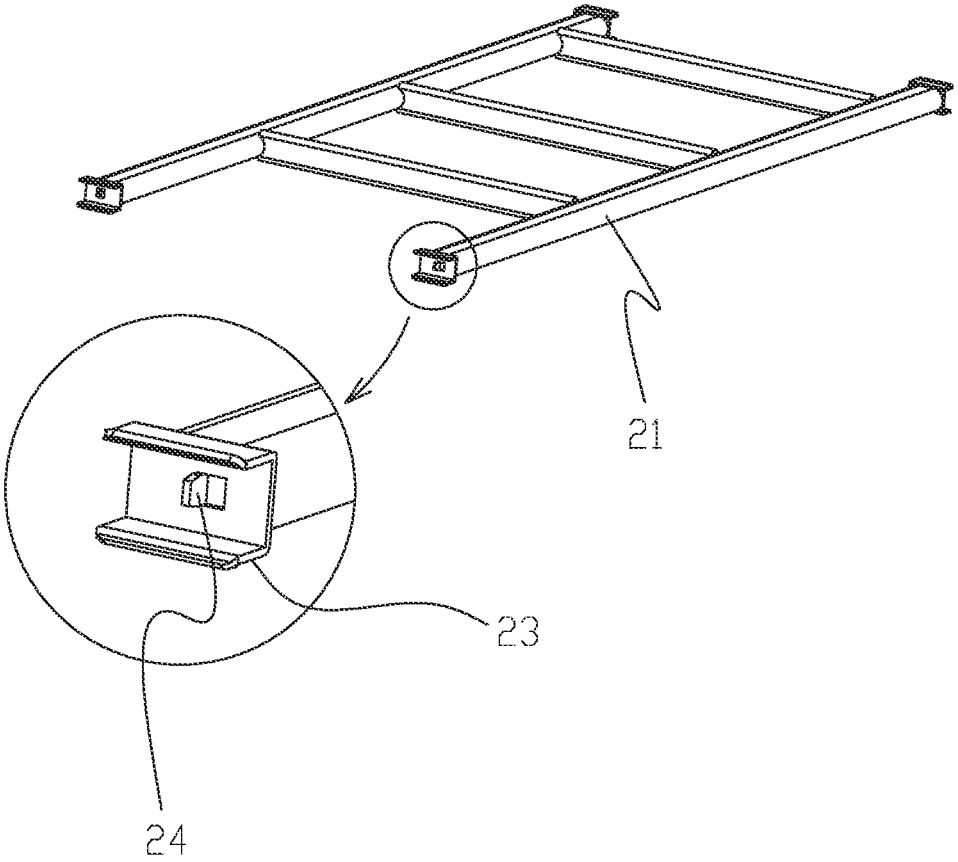
FIG. 3 illustrates an enlarged view of an upper end position of the bed ladder in FIG. 1.
Figure 4:
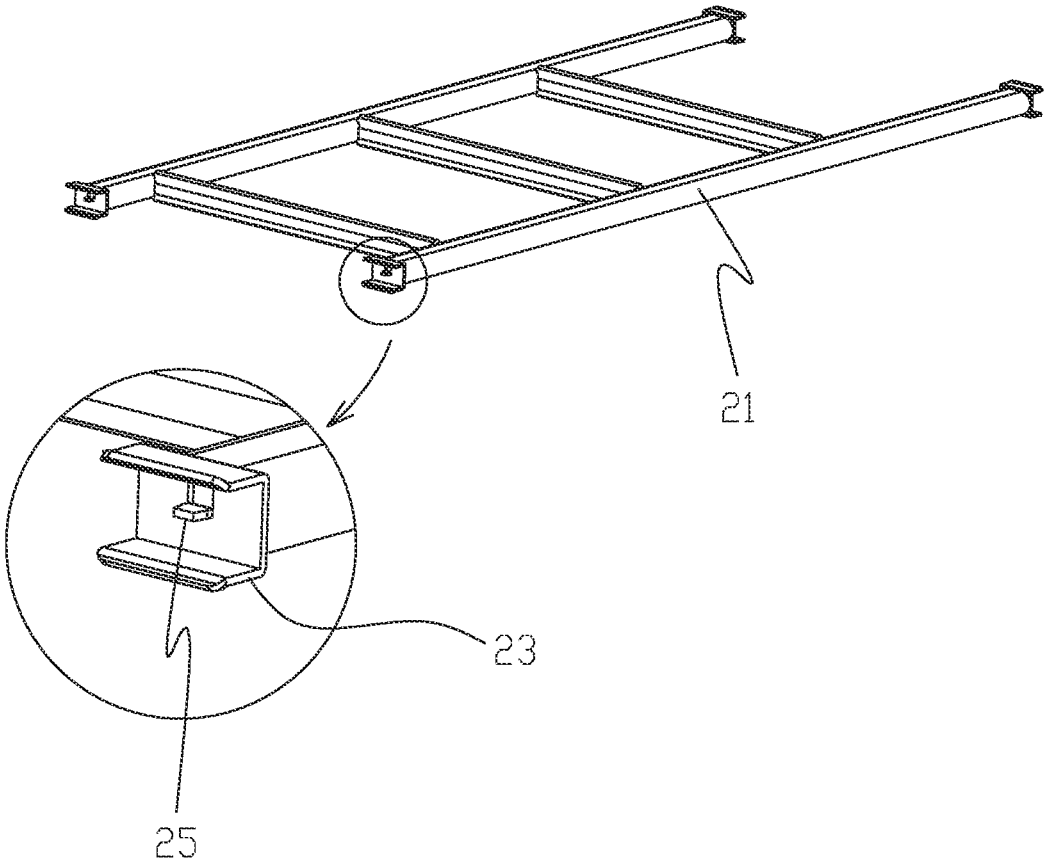
FIG. 4 illustrates an enlarged view of a lower end position of the bed ladder in FIG. 1.
Figure 5:
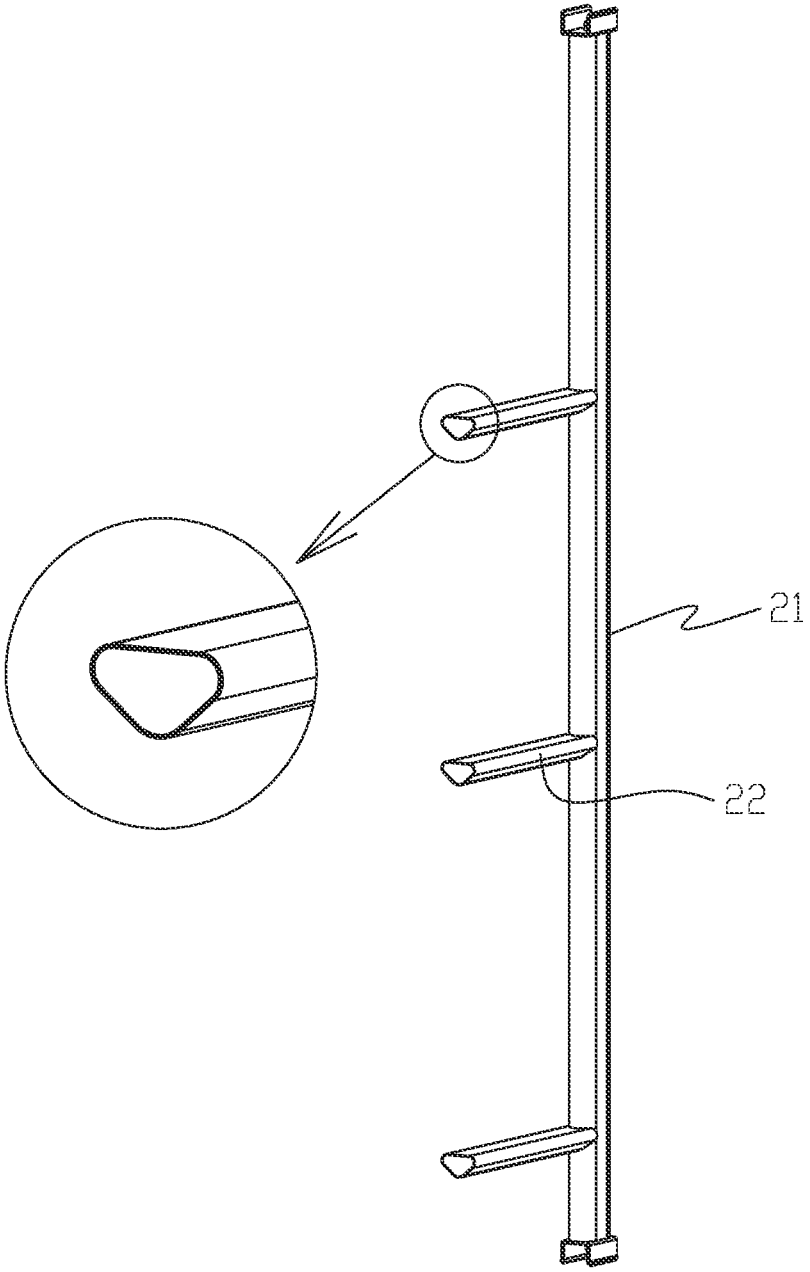
FIG. 5 illustrates a perspective view of the bed ladder with half of the bed ladder removed in FIG. 1, illustrating a cross section of a step bar.

The present disclosure will be further described below in combination with the accompanying drawings and embodiments.

Referring to FIG. 1 to FIG. 5, a bed ladder 20 configured to be installed on a bed frame 10 is provided, and the bed frame 10 comprises an upper frame 12, a lower frame 14, and four columns 16. The upper frame 12 can be used to form an upper bunk, and the lower frame 14 can be used to form a lower bunk or a lower support for supporting the upper frame 12. All sides of the upper frame 12 and all sides of the lower frame 14 are connected together by the four columns 16. Alternatively, the lower frame 14 can also be configured to be a desk instead of the lower bunk. The four columns 16 can also be integrated with the lower frame 14, and the four columns 16 do not have to be set individually.

The upper frame 12 comprises one or more upper frame transverse bars 121, and in this embodiment, the one or more upper frame transverse bars 121 are two upper frame transverse bars 121 symmetrically arranged in a left-and-right direction. The upper frame 12 comprises one or more upper frame longitudinal bars 122, and in this embodiment, the one or more upper frame longitudinal bars 122 are two upper frame longitudinal bars 122 symmetrically arranged in a front-and-rear direction. A length of the two upper frame longitudinal bars 122 is longer than that of the upper frame transverse bars 121, and a structure of the upper frame 12 can adopt an existing structure. Accordingly, the lower frame 14 comprises one or more lower frame transverse bars 141, and the one or more lower frame transverse bars 141 are two lower frame transverse bars 141 symmetrically arranged in the left-and-right direction. The lower frame 14 comprises one or more lower frame longitudinal bars 142, and the one or more lower frame longitudinal bars 142 are two lower frame longitudinal bars 142 symmetrically arranged in the front-and-rear direction. A length of the two lower frame longitudinal bars 142 is longer than that of the two lower frame transverse bars 141. A structure of the lower frame 14 can adopt an existing structure. The two upper frame transverse bars 121 are in parallel to the two lower frame transverse bars 141. A corresponding one of the two upper frame transverse bars 121 and a corresponding one of the two lower frame transverse bars 141 which are on a same side of the bed frame 10 are located on a same vertical plane.

The bed ladder 20 comprises two handrails 21 symmetrically arranged in the left-and-right direction and a plurality of step bars 22 connected to the two handrails 21. The plurality of step bars 22 are arranged at intervals in a height direction for a user to gradually ascend.

The bed ladder 20 is vertically arranged, and the corresponding one of the two upper frame transverse bars 121 and the corresponding one of the two lower frame transverse bars 141 on the same side cooperate with each other to clamp the bed ladder 20 to inhibit movement of the bed ladder 20 in a vertical direction. An upper end of each of the two handrails 21 is connected to the corresponding one of the two upper frame transverse bars 121 in an inserted manner (i.e., the upper end of each of the two handrails 21 is inserted into the corresponding one of the two upper frame transverse bars 121), and a lower end of each of the two handrails 21 is connected to the corresponding one of the two lower frame transverse bars 141 in an inserted manner (i.e., the lower end of each of the two handrails 21 is inserted into the corresponding one of the two lower frame transverse bars 141).

Preferably, two ends of each of the two handrails 21 respectively comprise two sleeves 23, and each of the two sleeves 23 has a U-shaped groove. The two sleeves 23 are respectively sleeved on the corresponding one of the two upper frame transverse bars 121 and the corresponding one of the two lower frame transverse bars 141. In this way, positioning of the two handrails 21 is convenient and the structure of the two handrails 21 is firmer. In this embodiment, an opening of the U-shaped groove has a splayed structure extending outwardly, so that the U-shaped groove can be sleeved on the corresponding one of the two upper frame transverse bars 121 or the corresponding one of the two lower frame transverse bars 141 more conveniently.

Preferably, the upper end of each of the two handrails 21 comprises a longitudinal tongue 24, and the longitudinal tongue 24 is located on a groove bottom of the U-shaped groove of a corresponding one of the two sleeves 23. The corresponding one of the two upper frame transverse bars 121 comprises a longitudinal opening configured to receive the longitudinal tongue 24 in an inserted manner (i.e., the longitudinal tongue 24 is inserted into the longitudinal opening of the corresponding one of the two upper frame transverse bars 121). The lower end of each of the two the handrails 21 comprises a transverse tongue 25, and the transverse tongue 25 is located on a groove bottom of the U-shaped groove of a corresponding one of the two sleeves 23. The corresponding one of the two lower frame transverse bars 141 comprises a transverse opening configured to receive the transverse tongue 25 in an inserted manner (i.e., the transverse tongue 25 is inserted into the transverse opening of the corresponding one of the two lower frame transverse bars 141).

Preferably, each of the plurality of step bars 22 is a hollow pipe with a triangular cross section.

Preferably, each end of each of the plurality of step bars 22 is connected to the two handrails 21 in an inserted manner (i.e., each end of each of the plurality of step bars 22 is inserted into to the two handrails 21), so that the two handrails 21 are configured to clamp the plurality of step bars 22 to inhibit movement of the plurality of step bars 22 in the left-and-right direction.

Preferably, all sides of the upper frame 12 of the bed frame 10 are disposed with guardrails 123. The two upper frame transverse bars 121 are two lower bottom bar of a corresponding two of the guardrails 123, and the two upper frame longitudinal bars 122 are two lower bottom bar of a corresponding two (i.e., the other two) of the guardrails 123. In this embodiment, components can be omitted in this way, and the bed ladder 20 can be fixed directly by the guardrails from top to bottom.

Preferably, the bed ladder 20 is located on a side of the bed frame 10 in a width direction. That is to say, the bed ladder 20 is disposed on a side of the bed frame 10 (i.e., a head or an end of the bed frame 10).

Preferably, one or more of the guardrails 123 corresponding to the bed ladder 20 comprises an opening 124 aligned with the bed ladder 20, and a width of the opening 124 is the same as a width of the bed ladder 20.

Preferably, the upper frame 12 and the lower frame 14 of the bed frame 10 are connected together by the four columns 16, and the four columns 16 are disposed at four corners of the bed frame 10. An upper end of the four columns 16 is connected to a side bar of the guardrails 123 in an inserted manner (i.e., an upper end of the four columns 16 is inserted into a side bar of the guardrails 123), and a lower end of the four columns 16 is connected to a supporting leg of the lower frame 14.

Preferably, the opening 124 of the one or more of the guardrails 123 is located in a middle of the one or more of the guardrails 123. Two vertical side bars 125 on two sides of the one or more of the guardrails 123 are respectively connected to two of the four columns 16. A lower end of each of two vertical side bars 126 on a left side and a right side of the opening 124 is terminated at one of the two lower bottom bars of a corresponding two of the guardrails 123, and the two vertical side bars 126 on the left side and the right side of the opening 124 are vertically aligned with the two handrails 21 of the bed ladder 20 respectively. Further preferably, a cross-sectional shape and a size of each of the two handrails 21 are the same as that of each of the two vertical side bars 126, so that the two vertical side bars 126 and the two handrails 21 are similar to an integrated structure extending vertically down to the corresponding one of the two lower frame transverse bars 141.

In this embodiment, the bed frame 10 is a metal bed frame, and the bed ladder 20 is a metal bed ladder.

Figure 6:
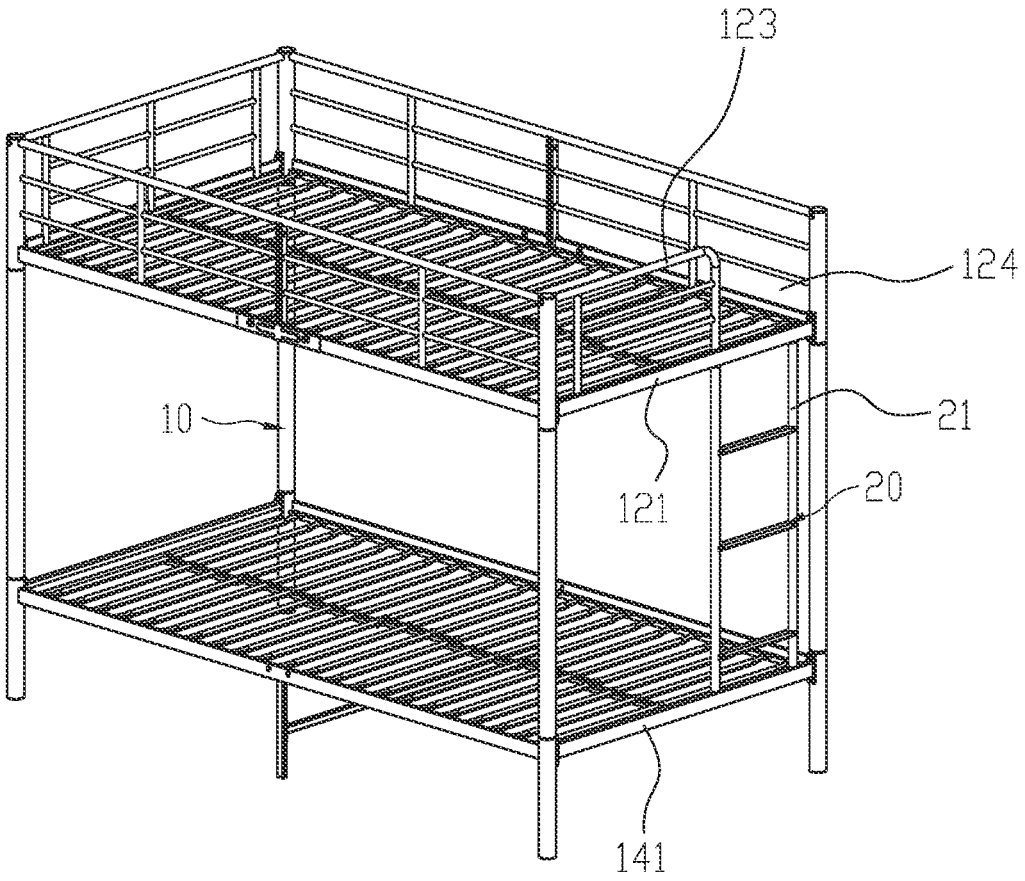
FIG. 6 illustrates a perspective view of a bed ladder configured to be installed on a bed frame for use in a second embodiment of the present disclosure.
Figure 7:
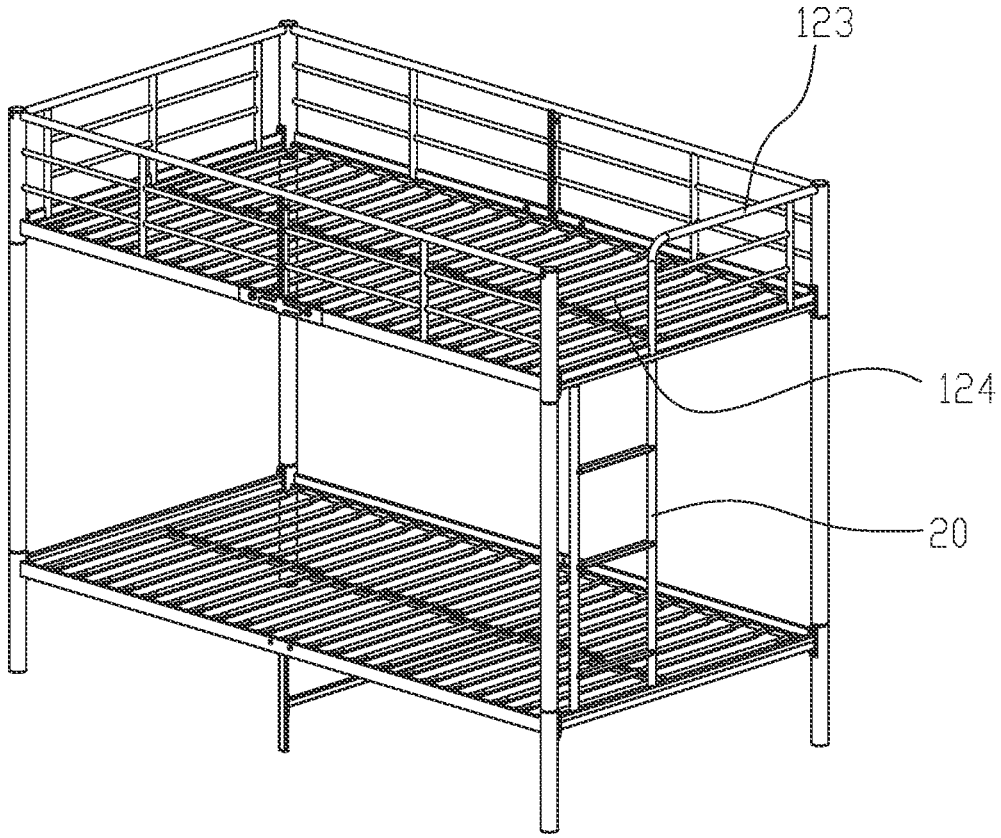
FIG. 7 illustrates a perspective view of a bed ladder configured to be installed on a bed frame for use in a third embodiment of the present disclosure.
Figure 8:
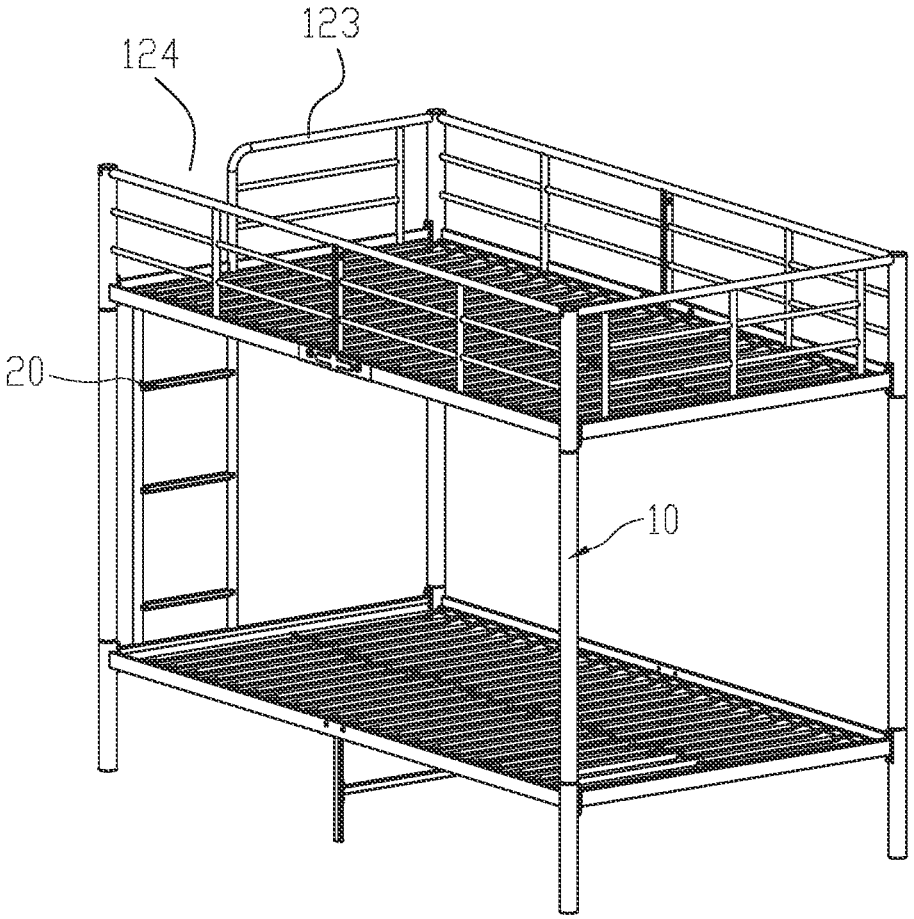
FIG. 8 illustrates a perspective view of a bed ladder configured to be installed on a bed frame for use in a fourth embodiment of the present disclosure.
Figure 9:
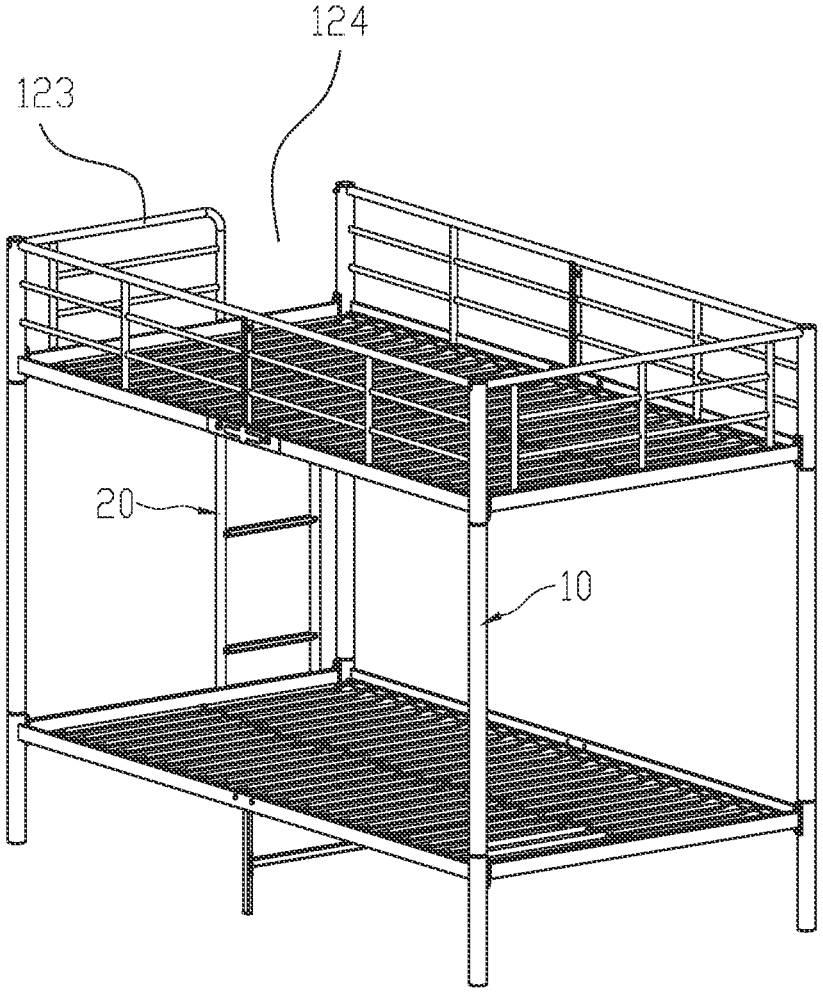
FIG. 9 illustrates a perspective view of a bed ladder configured to be installed on a bed frame for use in a fifth embodiment of the present disclosure.

Referring to FIG. 6, another embodiment of the present disclosure is provided. The difference from the structure of the bed ladder 20 installed on the bed frame 10 shown in FIG. 1 is that the opening 124 of the one or more of the guardrails 123 is located on a side position of the one or more of the guardrails 123. Preferably, the corresponding one of the two upper frame transverse bars 121 and the corresponding one of the two lower frame transverse bars 141 each comprise a receiving hole for receiving an end portion of each of the two handrails 21. Alternatively, the corresponding one of the two upper frame transverse bars 121 and the corresponding one of the two lower frame transverse bars 141 are all provided with a joint for being inserted into the end portion of each of the two handrails 21. It can be understood that since the opening 124 of the one or more of the guardrails 123 is located on the side position of the one or more of the guardrails 123, the opening 124 is located on a right side and an inner position of the bed frame 10 in FIG. 6, and a position of the opening 124 can be changed to be located on the right side and an outer position of the bed frame 10 (as shown in FIG. 7). Further, the bed ladder 20 can be located on a left side of the bed frame 10 (as shown in FIGS. 8 and 9).

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A bed ladder configured to be installed on a bed frame, wherein:

the bed frame comprises an upper frame transverse bar and a lower frame transverse bar, the upper frame transverse bar and the lower frame transverse bar are parallel to each other and located on a same vertical plane, the bed ladder comprises two handrails symmetrically arranged in a left-and-right direction and a plurality of step bars connected to the two handrails, the bed ladder is vertically arranged, the upper frame transverse bar and the lower frame transverse bar cooperate with each other to clamp the bed ladder to inhibit movement of the bed ladder in a vertical direction, an upper end of each of the two handrails is connected to the upper frame transverse bar in an inserted manner, a lower end of each of the two handrails is connected to the lower frame transverse bar in an inserted manner, the upper end and the lower end of each of the two handrails respectively comprise two sleeves, each of the two sleeves has a U-shaped groove, and the two sleeves are respectively sleeved on the upper frame transverse bar and the lower frame transverse bar using the U-shaped groove.

2. The bed ladder configured to be installed on the bed frame according to claim 1, wherein:

the upper end of each of the two handrails comprises a longitudinal tongue, the upper frame transverse bar comprises a longitudinal opening configured to receive the longitudinal tongue in an inserted manner, the lower end of each of the two handrails comprises a transverse tongue, and the lower frame transverse bar comprises a transverse opening configured to receive the transverse tongue in an inserted manner.

3. The bed ladder configured to be installed on the bed frame according to claim 1, wherein:

the upper frame transverse bar and the lower frame transverse bar each comprise a receiving hole for receiving an end portion of each of the two handrails, or the upper frame transverse bar and the lower frame transverse bar each comprise a joint for being inserted into the end portion of each of the two handrails.

4. The bed ladder configured to be installed on the bed frame according to claim 1, wherein:

each of the plurality of step bars is a hollow pipe with a triangular cross section.

5. The bed ladder configured to be installed on the bed frame according to claim 4, wherein:

each end of each of the plurality of step bars is connected to the two handrails in an inserted manner, so that the two handrails are configured to clamp the plurality of step bars to inhibit movement of the plurality of step bars in the left-and-right direction.

6. The bed ladder configured to be installed on the bed frame according to claim 1, wherein:

each end of each of the plurality of step bars is connected to the two handrails in an inserted manner, so that the two handrails are configured to clamp the plurality of step bars to inhibit movement of the plurality of step bars in the left-and-right direction.

7. The bed ladder configured to be installed on the bed frame according to claim 1, wherein:

all sides of an upper frame of the bed frame are disposed with guardrails, and the upper frame transverse bar is a lower bottom bar of a corresponding one of the guardrails.

8. The bed ladder configured to be installed on the bed frame according to claim 7, wherein:

one or more of the guardrails corresponding to the bed ladder comprises an opening aligned with the bed ladder, and a width of the opening is the same as a width of the bed ladder.

9. The bed ladder configured to be installed on the bed frame according to claim 8, wherein:

the upper frame of the bed frame and a lower frame of the bed frame are connected together by four columns, and the four columns are disposed at four corners of the bed frame.

10. The bed ladder configured to be installed on the bed frame according to claim 9, wherein:

the opening of the one or more of the guardrails is located in a middle of the one or more of the guardrails, two first vertical side bars on two sides of the one or more of the guardrails are respectively connected to two of the four columns, a lower end of two second vertical side bars on a left side and a right side of the opening is terminated at the lower bottom bar of the corresponding one of the guardrails, and the two second vertical side bars on the left side and the right side of the opening are vertically aligned with the two handrails of the bed ladder respectively.

11. The bed ladder configured to be installed on the bed frame according to claim 10, wherein:

a cross-sectional shape and a size of each of the two handrails are the same as that of each of the two second vertical side bars.

12. The bed ladder configured to be installed on the bed frame according to claim 8, wherein:

the opening of the one or more of the guardrails is located in a side position of the one or more of the guardrails.

13. The bed ladder configured to be installed on the bed frame according to claim 1, wherein:

the bed ladder is located on a side of the bed frame in a width direction having a width less than a length of the bed frame.

14. The bed ladder configured to be installed on the bed frame according to claim 13, wherein:

one or more guardrails corresponding to the bed ladder comprises an opening aligned with the bed ladder, and a width of the opening is the same as a width of the bed ladder.

15. The bed ladder configured to be installed on the bed frame according to claim 1, wherein:

the bed frame is a metal bed frame, and the bed ladder is a metal bed ladder.

* * * * *